United States Patent [19]

Suzuki et al.

[11] Patent Number: 4,464,002

[45] Date of Patent: Aug. 7, 1984

[54] ELECTRICAL CONNECTOR

[75] Inventors: Hiroyuki Suzuki, Machida; Ikuhiro Andoh, Kawasaki; Kouji Watanabe, Yokohama, all of Japan

[73] Assignee: Fujitsu Limited, Kawasaki, Japan

[21] Appl. No.: 268,644

[22] Filed: May 29, 1981

[30] Foreign Application Priority Data

May 29, 1980 [JP] Japan ..... 55-72033
May 29, 1980 [JP] Japan ..... 55-74480[U]

[51] Int. Cl.[3] ..... H01R 13/38
[52] U.S. Cl. ..... 339/97 P; 339/99 R
[58] Field of Search ..... 339/97 R, 97 P, 98, 339/99 R

[56] References Cited

U.S. PATENT DOCUMENTS 3,777,299 12/1973 Nickerson et al. .
3,990,767 11/1976 Narozny ..... 339/97 P X
4,171,858 10/1979 Knowles ..... 339/99 R
4,190,952 3/1980 Thomas et al. ..... 339/99 R X

*Primary Examiner*—Howard N. Goldberg
*Assistant Examiner*—Timothy V. Eley
*Attorney, Agent, or Firm*—Staas & Halsey

[57] ABSTRACT

In an electrical connector, a contact comprises a first contact portion, a second contact portion having its axis parallel with the axis of the first contact portion and a connecting portion connecting the first and second contact portions. The angles of the connecting portion relative the axes of the first and second contact portions are capable of being changed. A plurality of these contacts are inserted into holes or channels of an insulator member of the connector.

3 Claims, 17 Drawing Figures

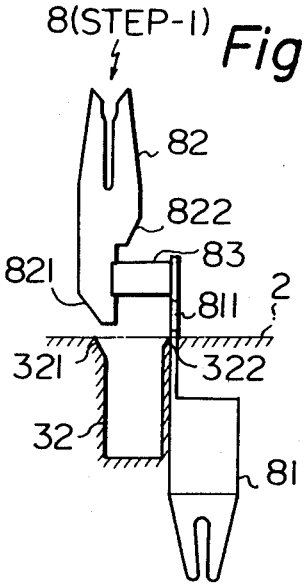
Fig. 13A
Fig. 13B
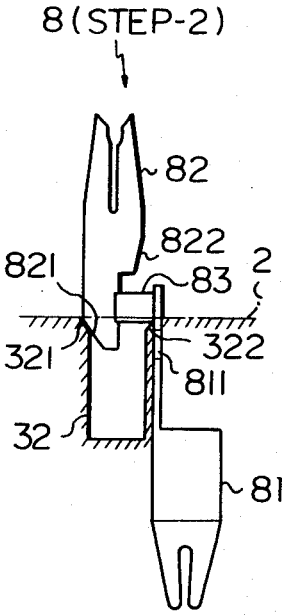
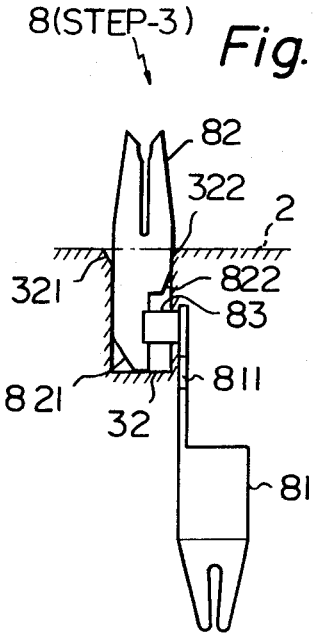
Fig. 13C

ELECTRICAL CONNECTOR

BACKGROUND OF THE INVENTION

This invention relates to an electrical connector, and more particularly to an electrical connector which has first contact portions and second contact portions of contacts with different pitches.

Generally, in the case of connecting an electrical connector to a flat cable, i.e., a planar laminated cable, the spacing between the conductors of the cable may be different than that between conductive elements of the connector to be connected to the cable. In such a case, a prior art electrical connector as shown in FIGS. 1 and 2 is used. FIG. 1 is a cross-sectional view of the structure of this connector and FIG. 2 is a perspective view of a contact used in the connector of FIG. 1. In the connector of FIG. 1, a plurality of contacts 1*a*′ through 1*g*′ are inserted and attached into an insulator member 2′. One of these contacts, e.g. the contact 1*d*′, is shown in FIG. 2. As shown in FIG. 2, the contact 1*d*′ has a first contact portion 11′, a second contact portion 12′ and a connecting portion 13′ which connects the first and the second contact portions. In the connector of FIG. 1, the plurality of first contact portions 11′ which are to mate with corresponding individual contacts of another connector are arranged in a pitch $L_a'$, and the plurality of second contact portions 12′ which are to be connected to a flat cable are arranged in a pitch $L_b'$. These respective pitches $L_a'$, $L_b'$ are different from each other, for example, $L_a'=2.76$ mm and $L_b'=2.54$ mm. Since the pitches La′ and Lb′ of the respective first and second contact portions are different from each other as above described, the connecting portions of the respective contacts 1*a*′ through 1*g*′ have inclinations to the axes of their respective first and second contact portions which likewise are necessarily different from each other. In the connector of FIG. 1, the first and the second contact of each contact portions have the same axis before transformation to the positions in the connector to which they respectively are be attached. When so transformed, the contacts are inserted into the respective proscribed holes, or channels, formed in the insulator member 2′.

The connector of FIG. 1 comprises one contact 1*d*′ in which the first and the second contact portions 11′, 12′ have the same axis and other contacts 1*a*′, 1*b*′, 1*c*′, 1*e*′, 1*f*′ and 1*g*′ in which the respective first and second contact portions 11′, 12′ are connected through the connecting portion 13′ inclined by small, but different and successively grater angles. Therefore, there is a problem in that the height H′ of the connector shown in FIG. 1 is increased and hence the overall size of the connector becomes larger. There is another problem in that it requires much time and skill to shape each of contacts 1*a*′ through 1*g*′ for the adjustment of the pitch $L_b'$ of the second contact portions 12′. The above mentioned prior art electrical connector is described, for example, in U.S. Pat. No. 3,777,299.

SUMMARY OF THE INVENTION

The main object of the present invention is to provide an improved electrical connector which is more applicable for connection with a flat cable, more economical and simpler than the prior art devices.

In accordance with the present invention, there is provided an electrical connector having a plurality of contacts and an insulator member, each of the contacts comprising a first contact portion, a second contact portion having its axis parallel with the axis of said first contact portion, and a connecting portion connecting the first and second contact portions, the angles of the connecting portion relative to the axes of the first and second contact portions being capable of being changed. Moreover, the plurality of contacts are inserted into holes in the insulator member such that the angles of the connecting portions relative to the axes of the first and second contact portions are set to predetermined values, whereby the distances between the second contact portions of the adjacent contacts are adjusted to predetermined values.

In a preferred embodiment of the present invention, first contacting portion of contact is used for mating with another connector element, and the second contact portion is used for connection with the flat cable. In another preferred embodiment of the present invention, there is provided a rotation stopper for the first contact portion at the non-contacting end of the first contact portion.

In another preferred embodiment of the present invention, the angles of the connecting portions relative to the axes of the associated first and second contact portions of the respective connectors are formed by bending the connector portions automatically to the predetermined values when the contacts are inserted into the insulator member.

BRIEF DESCRIPTION OF THE DRAWINGS

FIGS. 13A through 13C illustrate the process of inserting the contact of FIG. 12 into the insulator member.

DESCRIPTION OF THE PREFERRED EMBODIMENTS

Figure 3:
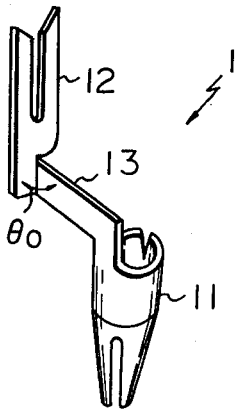
FIG. 3 is a persepctive view of a contact used in an electrical connector in accordance with an embodiment of the present invention.
Figure 4:
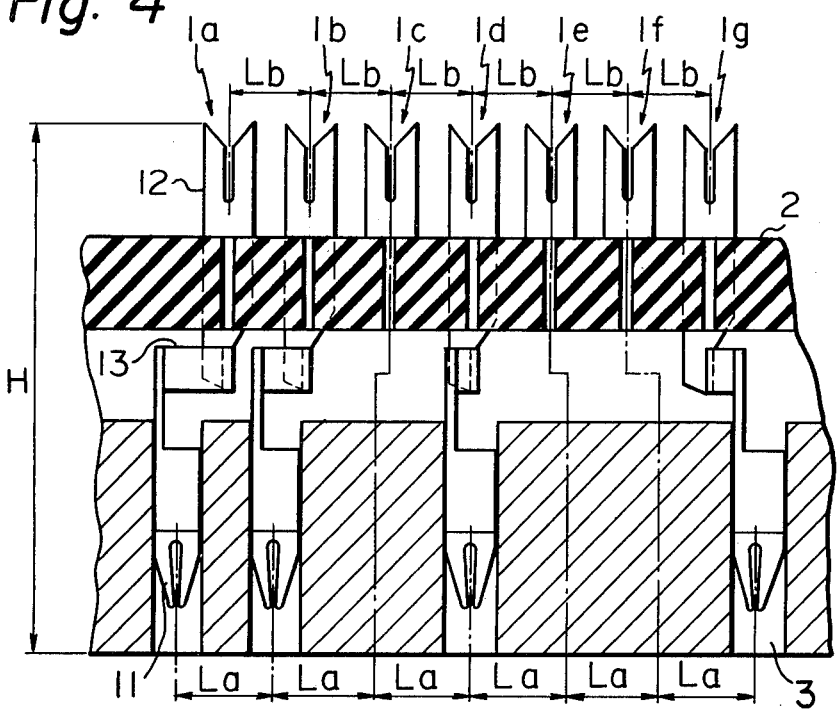
FIG. 4 is a sectional view of the structure of the connector of FIG. 5, taken along line IV—IV, using contacts of FIG. 3.
Figure 5:
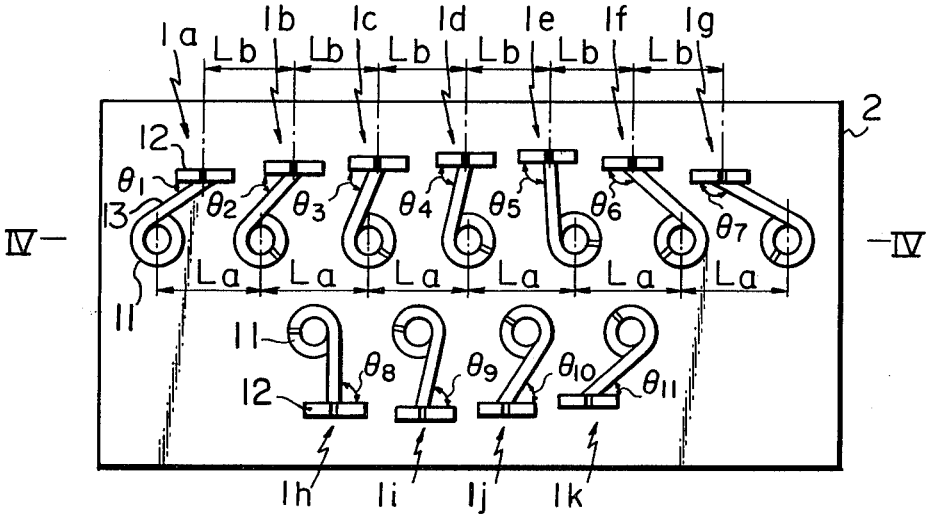
FIG. 5 is a schematic plan view of the same connector which is shown in sectional view in FIG. 4.

An electrical connector in accordance with an embodiment of the present invention is illustrated in FIGS. 3, 4 and 5. In FIG. 3, a contact 1 used in the above-mentioned connector is shown. The contact 1 has a first contact portion 11 for mating with another connector element, a second contact portion 12 for connection with a flat cable, and a connecting portion 13 connecting the respective first and second contact portions 11, 12. The axis of the first contact portion 11 is parallel with the axis of the second contact portion 12, and the angle $\theta$ between the second contact portion 12 and the connecting portion 13 is a predetermined value $\theta_0$ before it is attached to the connector, for example, $\theta_0=85°$.

FIGS. 4 and 5 illustrate the electrical connector showing the contacts 1 inserted and attached into an insulator member 2. FIG. 4 is a sectional view of the electrical connector according to the present invention and FIG. 5 is a schematic plan view of this connector. In FIG. 4, a plurality of contacts 1*a* through 1*g* are inserted into the insulator member 2. The first contact portions 11 of the contacts are arranged such that their axes are parallel with each other and are displaced by a constant interval or pitch $L_a$. Also the second contact portions 12 of contacts 1*a* through 1*g* are arranged such that their axes are parallel with each other and are displaced by a constant interval or pitch $L_b$.

FIG. 5 is a top view of the connector showing the contacts 1*a* through 1*g* attached thereto. As shown in FIG. 5 the first contact portions 11 of the contacts are arranged in two rows along the longitudinal dimension of the connector; the first contact portions 11 of the contacts 1*a* through 1*g* are arranged in the front row and those of the contacts 1*h* through 1*k* are arranged in a back row. The contacts shown in FIG. 4 correspond to those of the front row of FIG. 5. Each of the second contact portions 12 of the contacts 1*a* through 1*g* is positioned with its axis parallel to the longitudinal dimension of the connector and predetermined interval or pitch Lb along the longitudinal dimension of the connector.

In the connector of FIG. 5 the connecting portion 13 of each contact 1 is bent relative to the axes of the second contact portion 12, and the angle $\theta$ between the second contact portion 12 and the connecting portion 13 is changed in accordance with the position that the contact 1 is mounted, so that the pitch $L_b$ of the second contact portion 12 is set differently from the pitch $L_a$ of the first contact portion 13. As shown in FIG. 5, the angles $\theta_1$ through $\theta_7$ related to the contacts 1*a* through 1*g* are increased along the direction from 1*a* toward 1*g*.

As described above, in the connector using the contacts 1 of FIG. 3, making the pitch $L_a$ of the first contact portion 11 and the pitch $L_b$ of the second contact portion 12 different from each other can be attained simply and easily by bending the connecting portion 13 with regard to the second contact portion 12 so as to rotate the first contact portion 11 with the axis of the second contact portion 12 as a center. Furthermore, as the contact 1 of FIG. 3 has the connecting portion 13 arranged perpendicular relative to the axes of the respective first and second contact portions 11, 12, the height H of the connector shown in FIG. 4 becomes relatively small.

The formation of the angle of the connecting portion 13 can be accomplished by bending the connecting portion 13 to the predetermined angle $\theta$ before inserting the contact 1 into the insulator member 2, or by providing the holes or channels 3 formed in the insulator member 2 to insert the contacts 1 with an inclined portion so that when the contact 1 is inserted into the hole 3, the connecting portion 13 of that contact is bent automatically to the predetermined angle $\theta$ by being guided by the inclined portion of the hole 3.

Figure 6:
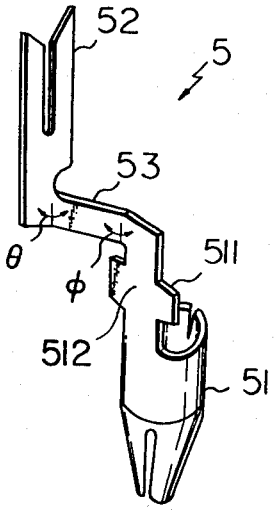
FIG. 6 is a perspective view of a contact used in the electrical connector of another embodiment of the present invention.
Figure 7:
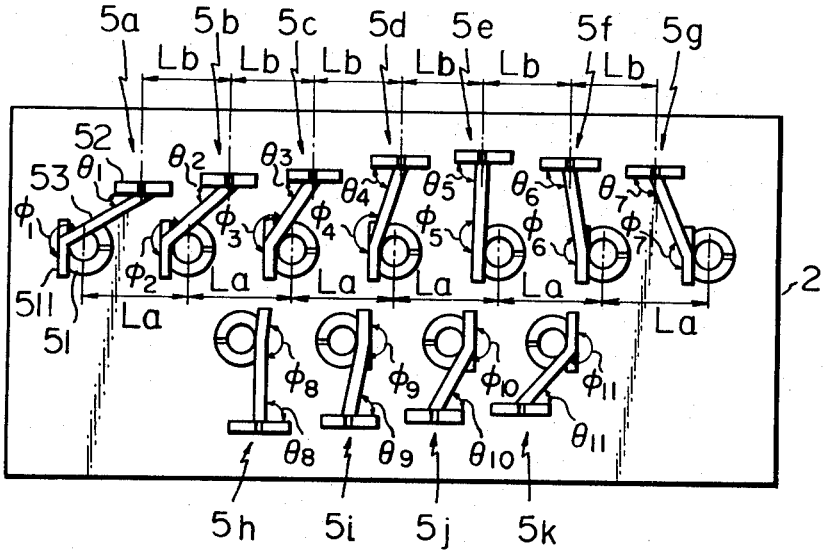
FIG. 7 is a schematic plan view of the connector with contacts of FIG. 6, FIGS. 8A through 8C illustrate the process of inserting the contact of FIG. 6 into the insulator member.
Figure 8A:
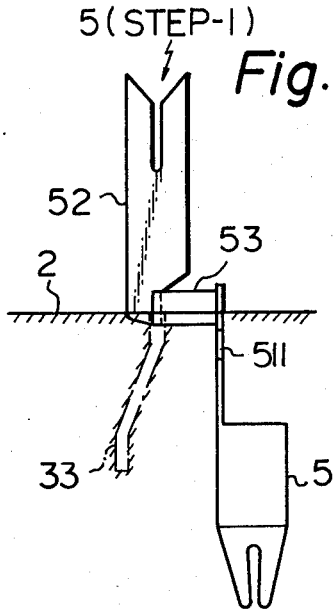
Figure 8B:
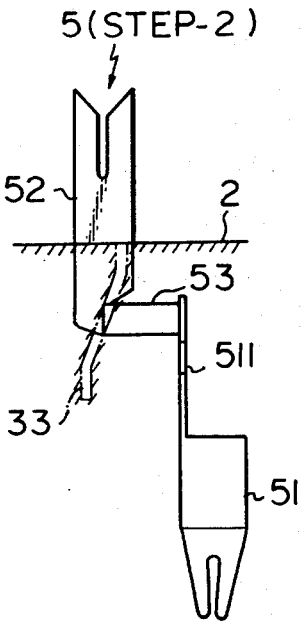
Figure 8C:
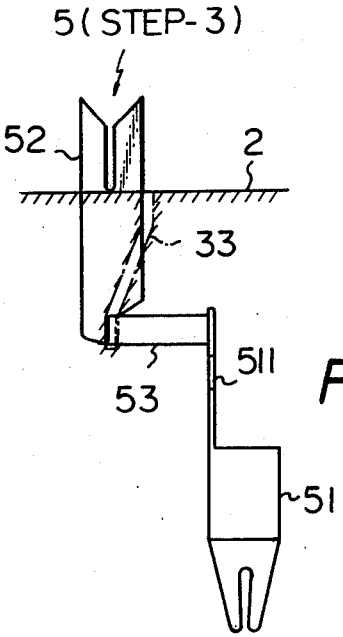

An electrical connector in accordance with another embodiment of the present invention is illustrated in FIGS. 6 and 7. FIG. 6 is a perspective view of a contact 5 used in the above mentioned connector, and FIG. 7 is a schematic plan view of this connector. As one method of constructing the connector of FIG. 7, the process of inserting the contact 5 into the insulator member 2 is illustrated in FIGS. 8A through 8C. The contact 5 comprises a first contact portion 51, a second contact portion 52 and a connecting portion 53 connecting these two contact portions 51, 52. The first contact portion 51 has a rotation stopper 511 formed as a projection on an upper end supporter 512. The angle between the upper end supporter 512 of the first contact portion 51 and the connecting portion 53, and the angle between the second contact portion 52 and the connecting portion 53 are expressed by $\phi$ and $\theta$, respectively.

The arrangement of the contacts 5 which are inserted into the insulator member 2 is illustrated in FIG. 7. A plurality of contacts 5*a* through 5*k* are inserted into corresponding holes formed in the insulator member 2. A groove corresponding to the stopper 511 for the first contact portion is provided at the portion of the respective hole for inserting the first contact portion 51 of the contact 5 so that rotation of the first contact portion 51 with regard to its axis is inhibited. In the connector of FIG. 7, in order to adjust the pitch $L_b$ of each of the second contact portion 52, two angles, that is, the angle $\phi$ between the first contact portion 51 and the connecting portion 53 of the contact, and the angle $\theta$ between the second contact portion 52 and the connecting portion 53 of the contact, are determined in accordance with the mounted position of the contact 5.

The process of the insertion of the connecting portion 53 of the contact 5 into the portion 33 of the respective hole in the insulator member 2 is illustrated in FIGS. 8A through 8C. FIG. 8A illustrates the first state (STEP-1) in which the insertion of the connecting portion 53 into the portion 33 of the hole is started. FIG. 8B illustrates the second state (STEP-2) in which the insertion is done half way. FIG. 8C illustrates the third state (STEP-3) in which the insertion is completed. As shown in FIGS. 8A through 8C, the portion 33 of the hole provided in the insulator member 2 corresponding to the connecting portion 53, is formed on the surface as correponding to the original shape of the contact 5 before bending, formed with a constant inclination to the inside from the surface, and finally formed so that the predetermined bent angle can be attained.

Figure 9:
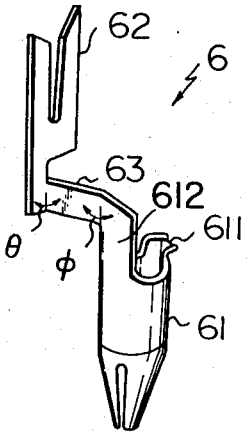
FIG. 9 is a perspective view of a contact used in the electrical connector of another embodiment of the present invention.

A contact 6 used in an electrical connector in accordance with another embodiment of the present invention is illustrated in FIG. 9. As shown in FIG. 9, the contact 6 has a first contact portion 61, a second contact portion 62 and a connecting portion 63. On the first contact portion 61, a rotation stopper 611 for the first contact portion is formed as a projection extending radially outward at the position opposite an upper end supporter 612 connected with the connecting portion 63 relative to the axis of the first contact portion 61. Therefore, in the connector using a plurality of contacts 6, a notch for the stopper 611 is cut on the respective hole formed in the insulator member 2 so that rotation of the first contact portion 61 is not allowed due to the mating of the stopper 611 with the notch. The remaining construction of the connector which uses the contact 6 of FIG. 9 is the same as that of the connector which uses the contact 5 of FIG. 6.

Figure 10:
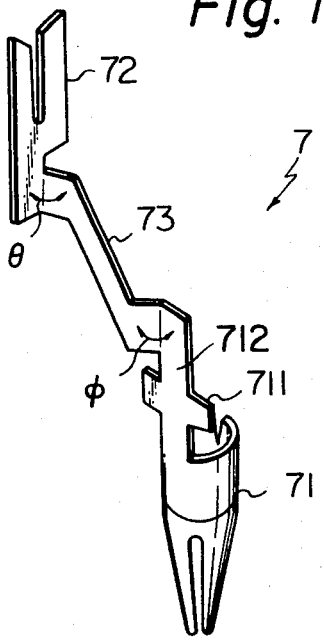
FIG. 10 is a perspective view of a contact used in the electrical connector of another embodiment of the present invention.
Figure 11:
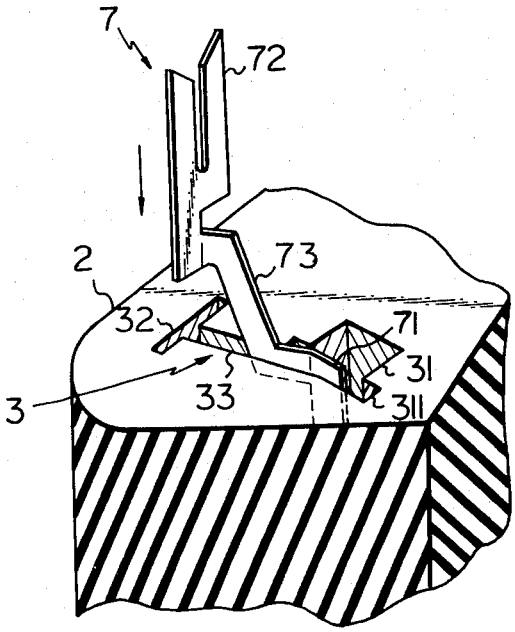
FIG. 11 is a perspective view illustrating the process of inserting the contact of FIG. 10 into an associated insulator member.

An electrical connector in accordance with another embodiment of the present invention is illustrated in FIGS. 10 and 11. FIG. 10 is a perspective view of a contact 7 used in this connector. FIG. 11 illustrates the contact 7 being inserted into the respective hole formed in the insulator member 2 in the above mentioned connector. As shown in FIG. 10, the contact 7 has a first contact portion 71, a second contact portion 72 and a connecting portion 73. On the first contact portion 71, a rotation stopper 711 is provided for it by forming a projection at the upper end supporter 712 in a manner similar to the contact 5 of FIG. 6. As shown in FIG. 10, the connecting portion 73 is arranged so that it has a constant inclination between the respective first and second contact portions 71, 72.

In FIG. 11, the hole 3 formed in the insulator member 2 has a first portion 31 corresponding to the first contact portion 71, a second portion 32 corresponding to the second contact portion 72, a third portion 33 corresponding to the connecting portion 73 and a groove 311 corresponding to the stopper 711. When inserting the contact 7 into the hole 3, at first the first contact portion 71 enters into the corresponding portion 31 of the hole 3, and then the stopper 711 is inserted into the groove 311. When the stopper 711 is inserted into the groove 311, it ensures that the first contact portion 71 is not allowed to rotate with regard to its axis. As shown in FIG. 11, from this point, by pushing the contact 7 into the hole 3 further, the inclined portion of the connecting portion 73 is inserted into the hole 3 continuously along the groove 33 defining the bent angle. When the inclined portion of the connecting portion 73 goes into the hole 3, the connecting portion 73 is forced to return to the defined bent angle by the inserting force.

Figure 12:
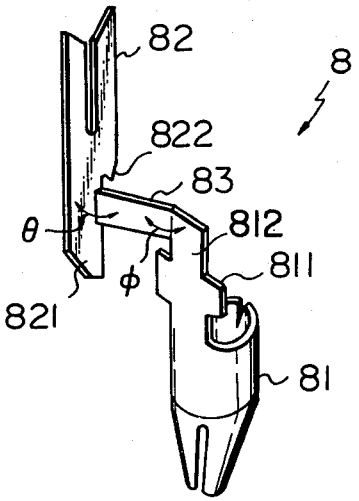
FIG. 12 is a perspective view of a contact for use in an electrical connector in accordance with a further embodiment of the present invention.

An electrical connector in accordance with a further embodiment of the present invention is illustrated in FIGS. 12 and 13. FIG. 12 is a perspective view of a contact 8 used in the above mentioned connector. FIGS. 13A through 13C illustrate the process in which the contact 8 is being inserted into the insulator member 2. As shown in FIG. 12, the contact 8 has a first contact portion 81 for mating with another connector contact, a second contact portion 82 for connecting with a conductor of a flat cable and a connecting portion 83 for connecting the first contact portion with the second contact portion. The first contact portion 81 is formed along a first axis and being formed of a cylindrical construction made by bending a plate and has a butting portion thereto. The first contact portion also has a supporter plate projecting along the first axis as a body extending upwardly from an upper end of the cylindrical first contact portion, and a rotation stopper 811 provided on the upper end supporter 812 of the contact portion 81. The second contact portion 82 has first and second tapering projections 821, 822 which extend from the lower end of the second contact portion 82.

In the above mentioned connector, the hole formed in the insulator member 2 for inserting the contact 8 has a groove 32 for mating with the second contact portion 82 of the contact 8. As shown in FIGS. 13A through 13C, the groove 32 has first and second guiding portions 321, 322 corresponding to the first and second tapering projections 821, 822 of the contact 8 respectively. In FIGS. 13A through 13C, there is shown the process in which the contact 8 is reformed so that the bent angles $\phi$ and $\theta$ of the connecting portion 83 come to the predetermined values. The second contact portion 82 is moved along the guiding portions 321, 322 of the groove 32 when the contact 8 is being inserted into the hole of the insulator member 2, as is illustrated in STEP-1, STEP-2 and STEP-3.

We claim:

1. An electrical connector comprising:

(a) a plurality of contacts, each of said contacts including (i) a first contact portion for mating with another connector contact, said first contact portion being formed along a first axis, being of a cylindrical construction, and having a butting portion, a supporter plate projecting along the first axis as a body extending upwardly from an upper end of the cylindrical first contact portion, and a rotation stopper projecting from a side of said supporter plate along an axis substantially perpendicular to the first axis;

(ii) a second contact portion for connecting with a conductor of a flat cable, said second contact portion being formed along a second axis parallel with and spaced a predetermined distance from the first axis, and having at least a pair of contact pieces with a slit formed therebetween and a tapering projection extending from a lower end of said second contact portion along the second axis with a taper at the lower end thereof; and (iii) a connecting portion for connecting said first contact portion with said second contact portion, said connecting portion being of a plate-like construction formed as a body so that an end thereof is connected to an upper side surface of the supporter plate and the other end thereof is connected to the second contact portion, the connecting portions of the contacts having a first angle relative to the first axes of said respective first contact portions and a second angle relative to the respective second axes of said respective second contact portions; and (b) at least one insulator member having a plurality of means for receiving corresponding contacts, each means including (i) a first hole for accommodating said first contact portion of said contact;

(ii) a second hole for accommodating said second contact portion of said contact;

(iii) a guide groove for inserting said contact and joining the first hole to the second hole; and (iv) a guide hole connected to said first hole for accommodating the rotation stopper, said first holes and second holes of said plurality of receiving means being arranged so that of said first contact portions and said second contact portions have different by inserting said contacts into said guide grooves and by bending said connecting portions of said contacts in planes substantially perpendicular to said first and second axes and when the connecting portion is bent, the first angle of the connecting portion relative to the first axis of said first contact portion and the second angle of the connecting portion relative to the second axis of said second contact portion is selectively changed for each of the contacts; and wherein said rotation stopper aligns the position of the butting portion of the first contact portion by stopping the rotation of the first contact portion around the first axis, cooperating with the guide hole and supporting the supporter plate so that a predetermined first angle between said connecting portion and the supporter plate is fixed when said first contact portion and the rotation stopper are inserted into the first hole and the guide hole, respectively, and then the tapering projection guides the insertion of said second contact portion by entering the tapering projection into the second hole prior to said second contact portion so that a predetermined second angle between said connecting portion and said second contact portion is fixed when said second contact portion is inserted into the second hole, the predetermined first and second angles being set for each contact so that pitch among said first contact portions is different from the pitch among said second contact portions.

2. An electrical connector as defined in claim 1, wherein said connecting portion of each contact is arranged perpendicular to the first and second axes between said first contact portion and said second contact portion.

3. An electrical connector as defined in claim 1, wherein said connecting portion of each contact is arranged to have an inclination to the first and second axes between said first contact portion and said second contact portion.

* * * * *

UNITED STATES PATENT AND TRADEMARK OFFICE

CERTIFICATE OF CORRECTION

PATENT NO. : 4,464,002

DATED : Aug. 7, 1984

INVENTOR(S) : Suzuki et al.

Figure 1:
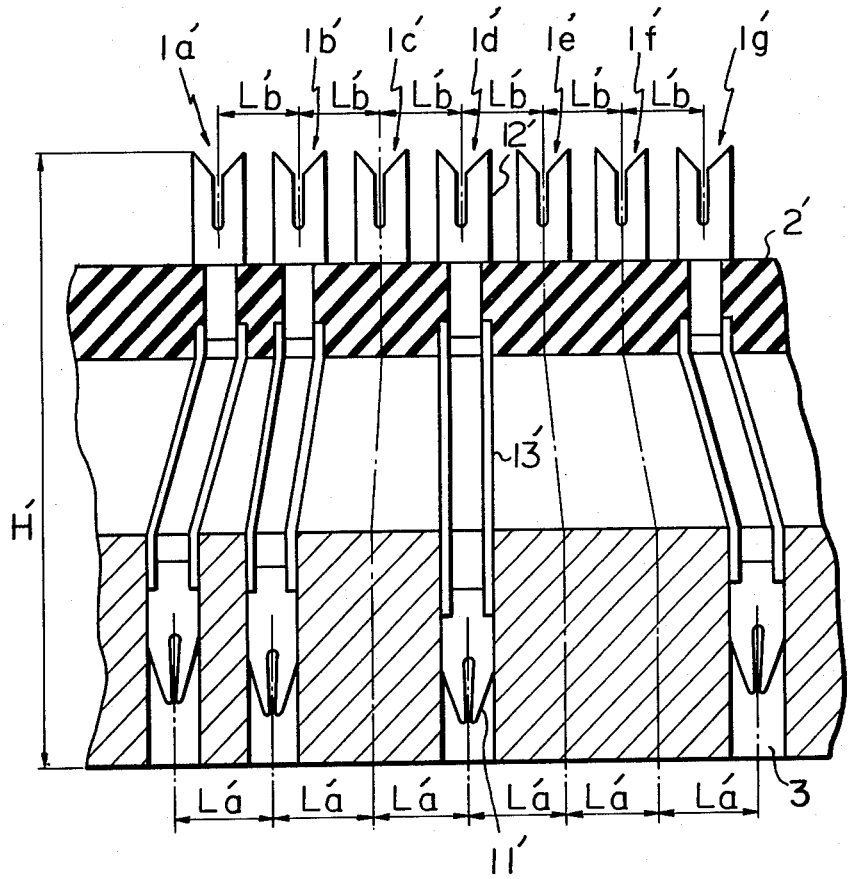
Fig. 1 (PRIOR ART)
FIG. 1 a sectional view of the structure of a prior art electrical connector.
Figure 2:
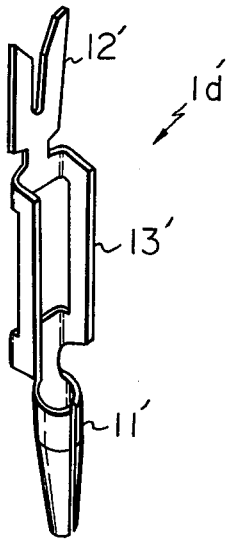
Fig. 2 (PRIOR ART)
FIG. 2 is a perspective view of the contact used in the connector of FIG. 1.

It is certified that error appears in the above-identified patent and that said Letters Patent is hereby corrected as shown below:

Column 1, line 5, after "particularly" insert --,--;
line 10, after "planar" insert --,--;
line 38, delete "of";
line 39, delete "each contact"; after "portions" insert --of each contact--;
line 41, after "are" insert --to--.
Column 2, line 2, "said" should be --the--;
line 15, after "invention," insert --the--;
line 16, after "of" insert --the--;
line 33, after "FIG. 1" insert --is--.
*Column 3, line 43, "Lb" should be --$L_b$--;
line 46, "axes" should be --axis--.
Column 4, line 38, "portion" should be --portions--.
Column 5, line 49, delete "being".
Column 6, line 60, delete "of".
Column 8, line 5, after "that" insert --the--.

Signed and Sealed this

Ninth Day of April 1985

[SEAL]

*Attest:*

DONALD J. QUIGG

*Attesting Officer* *Acting Commissioner of Patents and Trademarks*